US006308863B1

(12) United States Patent
Harman

(10) Patent No.: US 6,308,863 B1
(45) Date of Patent: Oct. 30, 2001

(54) DUAL CHAMBER PACKAGE FOR PRESSURIZED PRODUCTS

(75) Inventor: Robert E. Harman, Perrysburg, OH (US)

(73) Assignee: Owens-Brockway Plastic Products Inc., Toledo, OH (US)

( * ) Notice: Subject to any disclaimer, the term of this patent is extended or adjusted under 35 U.S.C. 154(b) by 0 days.

(21) Appl. No.: 09/387,398

(22) Filed: Sep. 2, 1999

(51) Int. Cl.[7] ..... B67D 5/52
(52) U.S. Cl. ..... 222/135; 222/183; 239/304
(58) Field of Search ..... 222/135, 137, 222/183; 239/304

(56) References Cited

U.S. PATENT DOCUMENTS

| | | | | |
|---|---|---|---|---|
| 3,236,418 | | 2/1966 | Dalle et al. . | |
| 3,236,457 | * | 2/1966 | Kennedy et al. | 239/304 |
| 3,269,605 | * | 8/1966 | Silver | 222/135 |
| 3,451,593 | * | 6/1969 | Dillarstone | 222/135 X |
| 3,613,956 | | 10/1971 | McCullouch . | |
| 3,635,372 | * | 1/1972 | Van Dyck et al. | 222/135 X |
| 4,773,562 | | 9/1988 | Gueret . | |
| 4,792,062 | * | 12/1988 | Goncalves | 222/135 |
| 4,826,048 | | 5/1989 | Skorka et al. . | |
| 4,902,281 | * | 2/1990 | Avoy | 239/304 X |
| 5,005,736 | | 4/1991 | Portas . | |
| 5,301,841 | * | 4/1994 | Fuchs | 222/135 |

* cited by examiner

*Primary Examiner*—Kevin Shaver
*Assistant Examiner*—Eric Keasel

(57) ABSTRACT

A package for containing and simultaneously dispensing first and second pressurized, fluent products, the package having a cup-shaped outer housing and first and second containers containing the first and second products, respectively, positioned within the outer housing. Each of the containers has a dispensing end with an actuatable valve at the dispensing end, and the opposed end of each of the containers is frictionally engaged by a fitment that is releasably secured to an open end of the outer housing. The outer housing is formed from a resilient polymeric material, and the closed end of the outer housing has an end member with first and second annular members depending therefrom to engage, respectively, the actuatable valves of the first and second containers. The end member of the outer housing is distortable under hand pressure to simultaneously actuate the actuatable valves of the first and second containers, and is provided with internal passages to cause the first and second pressurized, fluent products to flow to closely spaced dispensing openings.

4 Claims, 2 Drawing Sheets

DUAL CHAMBER PACKAGE FOR PRESSURIZED PRODUCTS

BACKGROUND OF THE INVENTION

1. Field of the Invention

This invention relates to a package for containing and simultaneously dispensing a plurality of fluent products. More particularly, this invention relates to a package of the foregoing character in which each of the products is pressurized in its packaged condition.

2. Description of the Prior Art

U.S. Pat. No. 5,005,736 (Portas) discloses a package that is made up of a pair of pressurized containers held together in a common frame. Products from the separate containers are simultaneously dispensed by providing a common pressure plate in engagement with the actuation valves of the separate containers with a single actuation key to operate the pressure plate to thereby operate the valves of the containers. The package of this reference requires a handle that projects perpendicularly from a plane extending through the central axes of the containers. Such handle, as well as the actuation key that extends thereabove, increases the area occupied by the package, which thereby substantially increases the space occupied by the package during shipment and storage, relative to the space that would be occupied by the pressurized containers themselves if packaged separately.

U.S. Pat. No. 4,773,562 (Gueret) also discloses a package that is made up of a pair of pressurized containers, the arrangement of this reference involving the use of a single shell, which is closed at its bottom end, surrounding the pressurized containers. The closed bottom end of the package of this reference would make it very difficult to replace the pressurized containers upon completion of the dispensing of their contents.

What is needed in the way of a package for two or more internally pressurized products that is not provided by the foregoing references, then, is a package for containing two or more pressurized products in separate containers that does not occupy materially more space than the total of that occupied by the containers themselves and readily permits replacement of the containers upon completion of the dispensing of their contents from the bottom of the package, away from the dispensing ends of the containers.

SUMMARY OF THE INVENTION

According to the present invention there is provided a package for two or more pressurized fluent products, each of which is contained in its own internally pressurized container. The bottom ends of the containers, that is, the ends away from the dispensing ends thereof, are removably engaged by a fitment, and the fitment is removably and replaceably secured to an open end of a cup-shaped outer housing, a body portion of which surrounds the body portions of the individual containers, which are positioned side by side within the outer housing. The outer housing is molded from a flexible polymeric material.

The upper end of each of the containers is provided with a dispensing valve that permits the contents of the container to be dispensed by the pressure within the container when the valve is deflected from its normal orientation. The outer housing has a domed end, and the domed end, which extends perpendicularly to the central axes of the pressurized containers engages the dispensing valves of the containers. Because the outer housing is formed from a flexible polymeric material, the domed end is manually distortable from a non-operating position to simultaneously deflect the dispensing valves of the pressurized containers, to thereby release products from each of the containers, and is provided with internal passages to permit the products being dispensed from the package to be dispensed in the same direction from closely spaced dispensing openings. The resilience of the material of the outer housing will cause the domed end thereof to return to its normal, non-operating position upon release of hand pressure or any other load imposed thereon to cause the contents of the containers to be dispensed.

Accordingly, it is an object of the present invention to provide an improved package for holding and simultaneously dispensing fluent products from at least two internally pressurized containers. More specifically, it is an object of the present invention to provide a package of the foregoing character that occupies not materially more than the space occupied by the containers themselves during shipment and storage.

It is also an object of the present invention to provide a package of the foregoing character whose outer housing can be reused, after the contents of the pressurized containers are exhausted, by replacing the containers within the outer housing.

For a further understanding of the present invention and the objects thereof, attention is directed to the drawing and the following brief description thereof, to the detailed description of the preferred embodiment, and to the appended claims.

DETAILED DESCRIPTION OF THE PREFERRED EMBODIMENT

Figure 1:
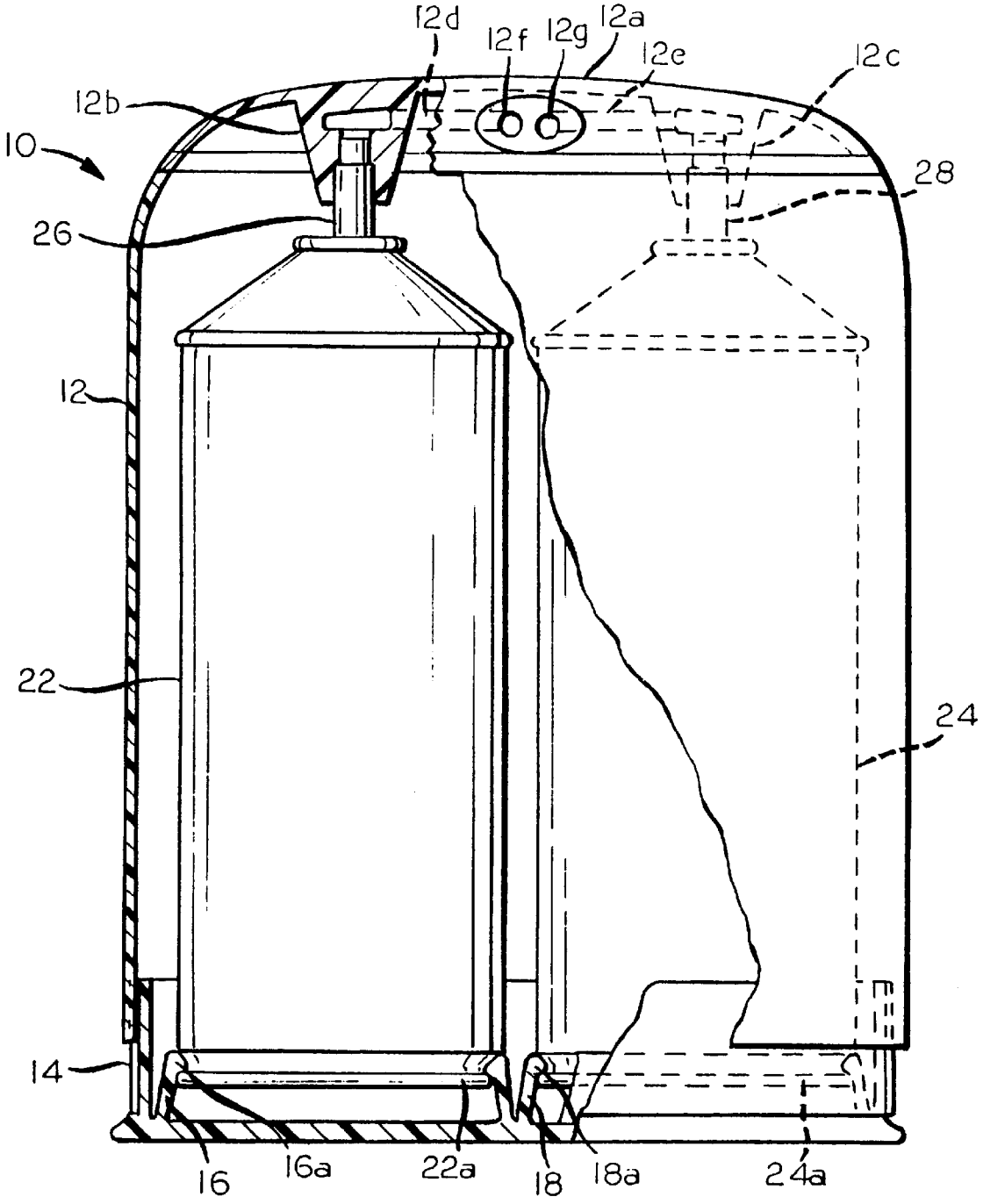
FIG. 1 is an elevational view, partly in cross-section, of a dual chamber package for pressurized products according to the preferred embodiment of the present invention.

A package according to the preferred embodiment of the present invention is identified generally by reference 10 and includes a cup-shaped outer housing 12 that is formed from a resilient polymeric material. A molded plastic fitment 14 is disengagably secured to an open end of the outer housing 12. The fitment 14 is provided with a side by side pair of annular members 16, 18 that project therefrom toward the interior of the housing 12, and the annular members 16, 18 are provided with radially inwardly projecting annular beads 16*a,* 18*a* respectively.

A pair of internally pressurized containers 22, 24 are positioned side by side within the outer housing 12, the containers 22, 24 being of conventional construction, of the type used in dispensing shaving products and other household products, if desired. The bottom or non-dispensing ends of the containers 22, 24 are frictionally and removably engaged by the annular members 16, 18, respectively, of the fitment 14, the containers 22, 24 being provided with radially inwardly projecting recesses 22*a,* 24*a,* respectively, that receive the beads 16*a,* 18*a,* respectively, of the annular members 16, 18.

The ends of the containers 22, 24 that are opposed to the ends having the recesses 22*a,* 24*a,* respectively, are provided with dispensing valves 26, 28, respectively, each of which is of the type that does not permit dispensing unless and until it is depressed or deflected from its normal, upright orientation by the application of a load, such as hand pressure thereto. The valves 26, 28 are positioned adjacent to a closed end 12*a* of the housing 12, and are physically engaged by side by side members 12*b*, 12*c*, respectively, that depend downwardly from the closed end 12*a*. The closed end 12*a* of the housing 12 is also provided with internal passages 12*d*, 12*e* that lead to closely spaced side by side dispensing ports 12*f*, 12*g*, respectively, from the dispensing valves 26, 28, respectively, to permit the contents of the containers 22, 24, respectively, to be dispensed in the same direction from closely spaced dispensing openings. By constructing the outer housing 12 from a resilient polymeric material, as described, the closed end 12*a* thereof can be manually distortable from its normal position, where there will be no dispensing from the containers 22, 24, by the application of a load such as hand pressure thereto. Upon removal of the distorting load, the closed end 12*a* of the outer housing 12 will return to its normal position, and the valves 26, 28 will return to their normal upright, non-dispensing positions.

Figure 2:
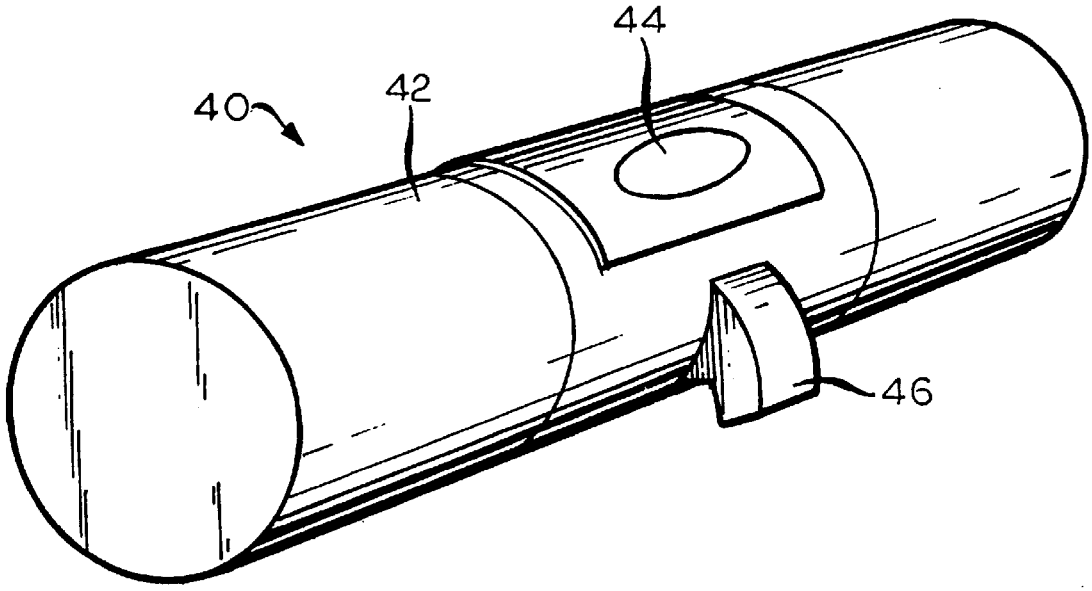
FIG. 2 is a perspective view of an alternative embodiment of a dual chamber package for pressurized products according to the present invention.

FIG. 2 illustrates an alternative embodiment of the present invention in which a package, generally identified by reference numeral 40, has a tubular outer housing 42. The outer housing 42 surrounds a pair of internally pressurized containers, not shown, which may be considered to correspond to the containers 22, 24 of the package 10 of the embodiment of FIG. 1. The containers within the package 40 are disposed co-axially, that is end to end, with their dispensing ends adjacent to one another. The package 40 is formed from a resilient polymeric material, and has a deformable portion 44 that, when deformed by a load applied thereby against, such as hand pressure, simultaneously actuates the dispensing valves of the pressurized containers within the package 40. A flip out spout 46 is provided to provide for side by side outlets for the products within the containers in the package 40, and the spout 46 is retractable when the package 40 is not in use, for example, during shipment or storage, to fit entirely within the outline of the package 40.

Although the best mode contemplated by the inventor for carrying out the present invention as of the filing date hereof has been shown and described herein, it will be apparent to those skilled in the art that suitable modifications, variations and equivalents may be made without departing from the scope of the invention, such scope being limited solely by the terms by the following claims and the legal equivalents thereof.

What is claimed is:

1. A package for containing and simultaneously dispensing first and second pressurized, fluent products, said package comprising:

an outer housing having a cup-shaped body member and a bottom member non-pivotably, removably secured to an open end of said body member, said bottom member having a spaced-apart pair of annular members extending generally transversely therefrom, each of said annular members having a bead extending inwardly therefrom;

a first container within the outer housing and containing the first pressurized, fluent product, said first container being cylindrical in configuration and having an actuatable valve at a first end for dispensing the first fluent product and a second end, said second end of said first container having an inwardly projecting recess and being removably engaged by said bottom member of said outer housing by projection of a bead of one of said annular members into said inwardly projecting recess of said first container;

a second container within the outer housing and containing the second pressurized, fluent product, said second container being cylindrical in configuration and having a actuatable valve at a first end for dispensing the second fluent product and a second end, said second end of said second container having an inwardly projecting recess and being removably engaged by said bottom member of said outer housing by projection of a bead of the other of said annular members into said inwardly projecting recess of said second container; and manually actuatable actuation means secured to said outer housing at an end of said body member away from the open end for simultaneously actuating the actuatable valve of said first container and the actuatable valve of said second container to simultaneously dispense the first pressurized, fluent product and the second pressurized, fluent product through said actuation means.

2. A package according to claim 1 wherein:

said outer housing is formed from a resilient polymeric material with said manually actuatable actuation means being formed integrally with said body member and disposed at an end of said body member that is opposed to said open end, said outer housing having first and second internal passages formed in said manually actuatable actuation means and leading, respectively, from the actuatable valve of said first container and the actuatable valve of said second container to first and second dispensing openings in said end member that are spaced more closely to one another than said actuatable valve of said first container and said actuatable valve of said second container.

3. A package according to claim 2 wherein said manually actuatable actuation means further comprises:

first and second side by side annular members formed integrally with said manually actuatable activation means and depending generally normally therefrom, said first annular member engaging the actuatable valve of said first container and said second annular member engaging the actuatable valve of said second container, said manually actuatable means being distortable under hand pressure to simultaneously cause said first annular member to actuate the actuatable valve of said first container and said second annular member to actuate the actuatable valve of said second container.

4. A package according to claim 1 wherein:

said first container and said second container are positioned side by side within said body member.

* * * * *